US006423917B2

(12) United States Patent
Narayanan et al.

(10) Patent No.: US 6,423,917 B2
(45) Date of Patent: Jul. 23, 2002

(54) SELF-DISENGAGING CIRCUIT BREAKER MOTOR OPERATOR

(75) Inventors: Janakiraman Narayanan, Hosur; Mahesh Jaywant Rane, Bangalore; Ramalingam Prem Anand, Chennai; Biranchi Narayana Sahu, Orissa; Dantuluri Varma, Secunderabad AP; Madhusudana Reddy Vanukuri, Hyderabad, all of (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,278

(22) Filed: Mar. 13, 2001

Related U.S. Application Data

(63) Continuation-in-part of application No. 09/595,278, filed on Jun. 15, 2000.

(60) Provisional application No. 60/190,765, filed on Mar. 20, 2000, and provisional application No. 60/190,298, filed on Mar. 17, 2000.

(51) Int. Cl.[7] ..... H01H 5/00

(52) U.S. Cl. ..... 200/400; 200/416; 335/68; 335/77

(58) Field of Search ..... 200/400, 401, 200/402, 406, 408, 409, 416, 438; 335/6–10, 15, 17, 38, 68–69, 70–73, 76–78

(56) References Cited

U.S. PATENT DOCUMENTS

| | | | | |
|---|---|---|---|---|
| 4,152,561 A | | 5/1979 | Maier et al. | 200/153 G |
| 4,336,516 A | | 6/1982 | Bratkowski et al. | 335/171 |
| 4,713,508 A | | 12/1987 | Baginski et al. | 200/153 |
| 5,148,913 A | * | 9/1992 | Bonnardel et al. | 200/400 |
| 5,504,290 A | | 4/1996 | Baginski et al. | 200/401 |
| 5,545,867 A | | 8/1996 | Castonguay et al. | 200/400 |
| 5,571,255 A | | 11/1996 | Baginski et al. | 200/401 |
| 5,944,172 A | * | 8/1999 | Hannula | 200/401 |
| 6,031,438 A | * | 2/2000 | Runyan | 335/172 |

FOREIGN PATENT DOCUMENTS

EP 0296 631 A2 6/1988

OTHER PUBLICATIONS

International Serach Report, dated Nov. 13, 2001, corresponding to the International Application No. PCT/US 01/40312 and a copy of each of the publications cited therein.

International Serach Report, dated Oct. 29, 2001, corresponding to the International Application No. PCT/US 01/08850 and a copy of each of the publications cited therein.

* cited by examiner

*Primary Examiner*—Lincoln N. Donovan
*Assistant Examiner*—Kyung S. Lee
(74) *Attorney, Agent, or Firm*—Cantor Colburn LLP

(57) ABSTRACT

A motor operator for a circuit breaker is disclosed. The motor operator includes a motor drive assembly connected to a mechanical linkage system for driving an energy storage mechanism from a first state of a plurality of states to a second state of a plurality of states. The motor operator also includes an energy release mechanism coupled to the mechanical linkage system for releasing the energy stored in the energy storage mechanism. The mechanical linkage system includes a recharging cam being driven by the motor drive assembly. The recharging cam rotates a drive plate rotatably mounted to the system. A linear carriage is coupled to the drive plate and the linear carriage manipulates an operating handle of a circuit breaker. The recharging cam is disengaged from the drive plate when the energy storage mechanism is compressed into an energy storage state and the drive plate is latched into a position corresponding to the energy stored state. The drive plate is released from its latching position by the energy release mechanism and the stored energy of the energy storage mechanism is released to manipulate the handle of the circuit breaker. The recharging cam is reconnected after the energy of the energy storage mechanism has been released.

25 Claims, 16 Drawing Sheets

SELF-DISENGAGING CIRCUIT BREAKER MOTOR OPERATOR

CROSS REFERENCE TO RELATED APPLICATIONS

This application claims the benefit of Provisional Application No. 60/190,765 filed on Mar. 20, 2000, and Provisional Application No. 60/190,298 filed on Mar. 17, 2000, the contents of which are incorporated herein by reference thereto. This application is a continuation-in-part of U.S. application Ser. No. 09/595,278 filed on Jun. 15, 2000, the contents of which are incorporated herein by reference thereto.

BACKGROUND OF INVENTION

This invention relates to a method and apparatus for remotely operating a circuit breaker.

Motor operators (motor charging mechanisms) allow the motor-assisted operation of electrical circuit breakers. A motor operator is typically secured to the top of a circuit breaker housing. A linkage system within the motor operator mechanically interacts with a circuit breaker operating handle, which extends from the circuit breaker housing. The linkage system is operatively connected to a motor within the motor operator. The motor drives the linkage system, which, in turn, moves the operating handle to operate the circuit breaker. The operating handle is moved between "on", "off", and "reset" positions, depending on the rotational direction of the motor.

When the handle is moved to the ON position, electrical contacts within the circuit breaker are brought into contact with each other, allowing electrical current to flow through the circuit breaker. When the handle is moved to the OFF position, the electrical contacts are separated, stopping the flow of electrical current through the circuit breaker. When the handle is moved to the "reset" position, an operating mechanism within the circuit breaker is reset, as is necessary after the operating mechanism has tripped in response to an overcurrent condition in the electrical circuit being protected by the circuit breaker.

The motor operator must be designed to prevent damage to the circuit breaker and to itself, when moving the circuit breaker handle to these various positions. In particular, the motor operator and the circuit breaker must be designed such that the "overtravel" of the handle past the reset position does not damage the circuit breaker operating mechanism. This is typically achieved by strengthening the motor operator and the circuit breaker so that they may withstand the stress caused by overtravel, or by use of a limit switch and solenoids to disengage the motor after the handle has reached a desired point.

While effective, the use of limit switches and solenoids to disengage the motor requires the use of many components and, therefore, increases the cost of the motor operator and its potential for failure.

SUMMARY OF INVENTION

A motor operator for a circuit breaker, the motor operator includes a motor drive assembly connected to a mechanical linkage system for driving an energy storage mechanism from a first state of a plurality of states to a second state of the plurality of states, each state having a prescribed amount of energy stored in the energy storage mechanism, the energy storage mechanism provides an urging force to the mechanical linkage system, the mechanical linkage system is coupled to a carriage assembly. A motor drive assembly is connected to the mechanical linkage system for driving the energy storage mechanism from a first state of said plurality of states to a second state of said plurality of states and a release mechanism disengages the motor drive assembly from the mechanical linkage system when the energy storage mechanism is driven from the first state of plurality of states to the second state and an energy release mechanism is coupled to the mechanical linkage system to release the energy stored in the energy storage mechanism. After the energy has been released from the energy storage mechanism the release mechanism reengages the motor drive assembly to the mechanical linkage system.

DETAILED DESCRIPTION

Figure 1:
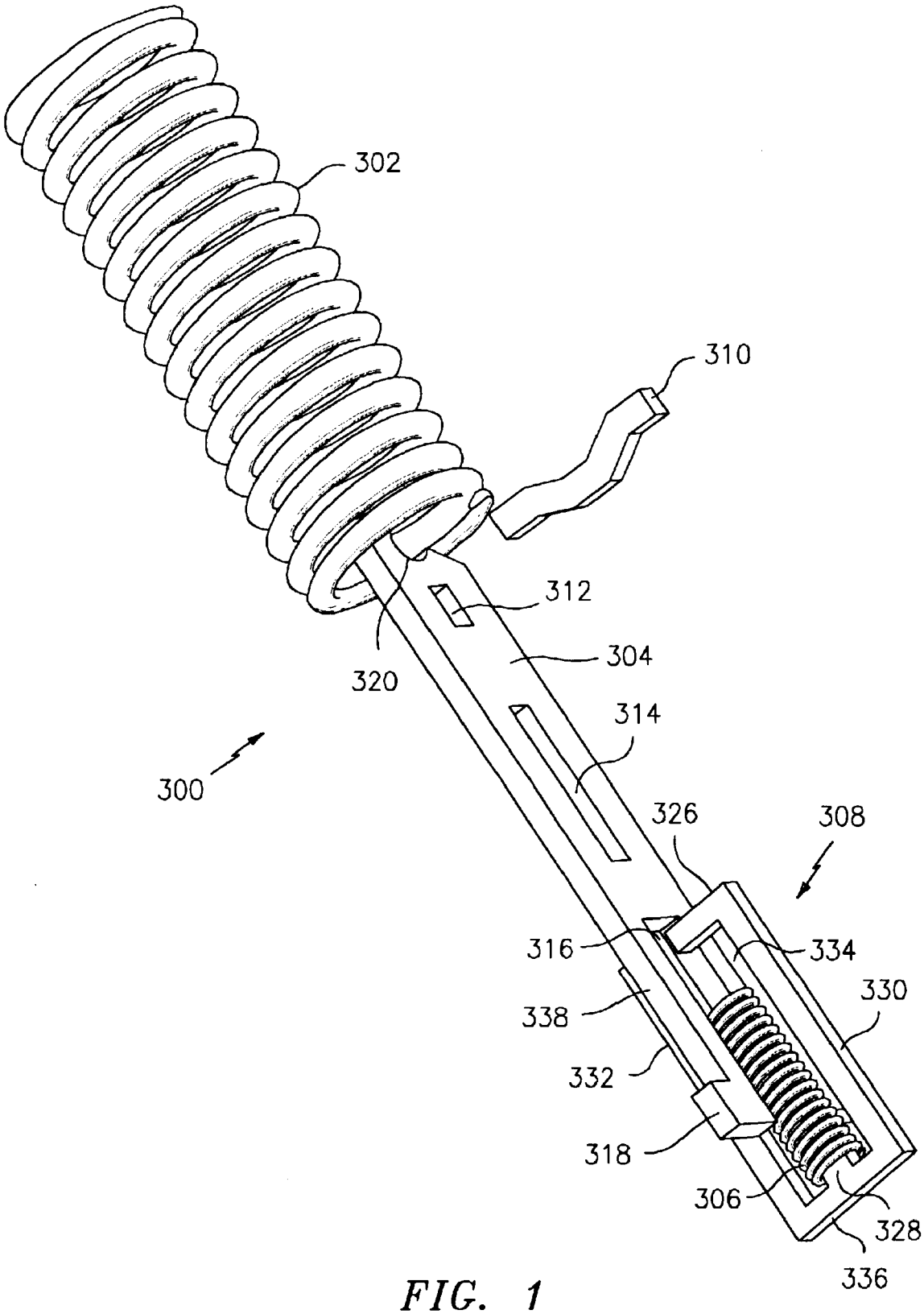
FIG. 1 is an exploded three-dimensional view of the energy storage mechanism of the present invention.

Referring to FIG. 1, an energy storage mechanism is shown generally at 300. Energy storage mechanism 300 comprises a main spring guide 304 (seen also in FIG. 3), a generally flat, bar-like fixture having a first closed slot 312 and a second closed slot 314 therein. Main spring guide 304 includes a semi-circular receptacle 320 at one end thereof and an open slot 316 at the opposing end. Main spring guide 304 includes a pair of flanges 318 extending outward a distance "h" (FIG. 3) from a pair of fork-like members 338 at the end of main spring guide 304 containing open slot 316. The pair of fork-like members 338 are generally in the plane of main spring guide 304.

Figure 2:
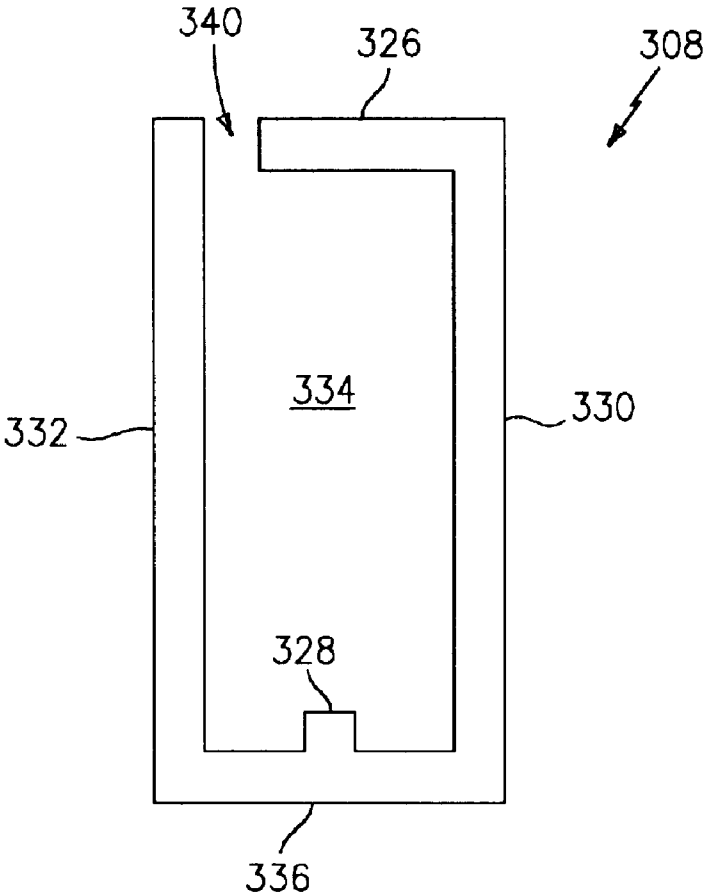
FIG. 2 is a view of the auxiliary spring guide of the energy storage mechanism of FIG. 1.

Energy storage mechanism 300 further comprises an auxiliary spring guide 308. Auxiliary spring guide 308 (seen also in FIG. 2) is a generally flat fixture having a first frame member 330 and a second frame member 332 generally parallel to one another and joined by way of a base member 336. A beam member 326 extends generally perpendicular from the first frame member 330 in the plane of auxiliary spring guide 308 near to second frame member 332 so as to create a clearance 340 (as seen in FIG. 2) between the end of beam member 326 and second frame member 332. Clearance 340 (as seen in FIG. 2) allows beam member 326, and thus auxiliary spring guide 308, to engage main spring guide 304 at second closed slot 314.

Beam member 326, first frame member 330, second frame member 332 and base member 336 are inserted into aperture 334. A tongue 328 extends from base member 336 into aperture 334. Tongue 328 is operative to receive an auxiliary spring 306, having a spring constant of $k_a$, whereby auxiliary spring 306 is retained within aperture 334. The combination of auxiliary spring 306, retained within aperture 334, and auxiliary spring guide 308 is coupled to main spring guide 304 in such a manner that beam member 326 is engaged with, and allowed to move along the length of, second closed slot 314. Auxiliary spring guide 308 is thereby allowed to move relative to main spring guide 304 by the application of a force to base member 336 of auxiliary spring guide 308. Auxiliary spring 306 is thus retained simultaneously within open slot 316 by the fork-like members 338 and in aperture 334 by first frame member 330 and second frame member 332.

Figure 3:
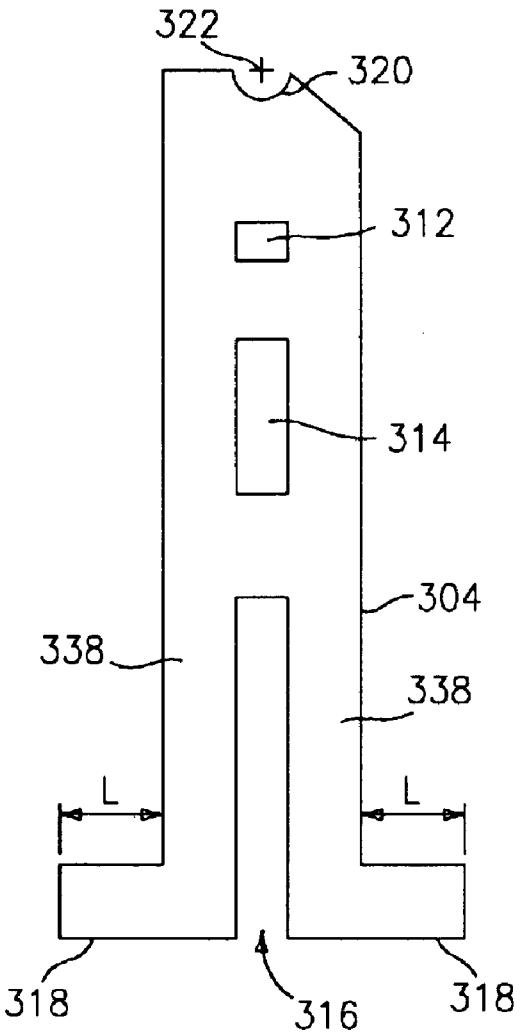
FIG. 3 is a view of the main spring guide of the energy storage mechanism of FIG. 1.
Figure 4:
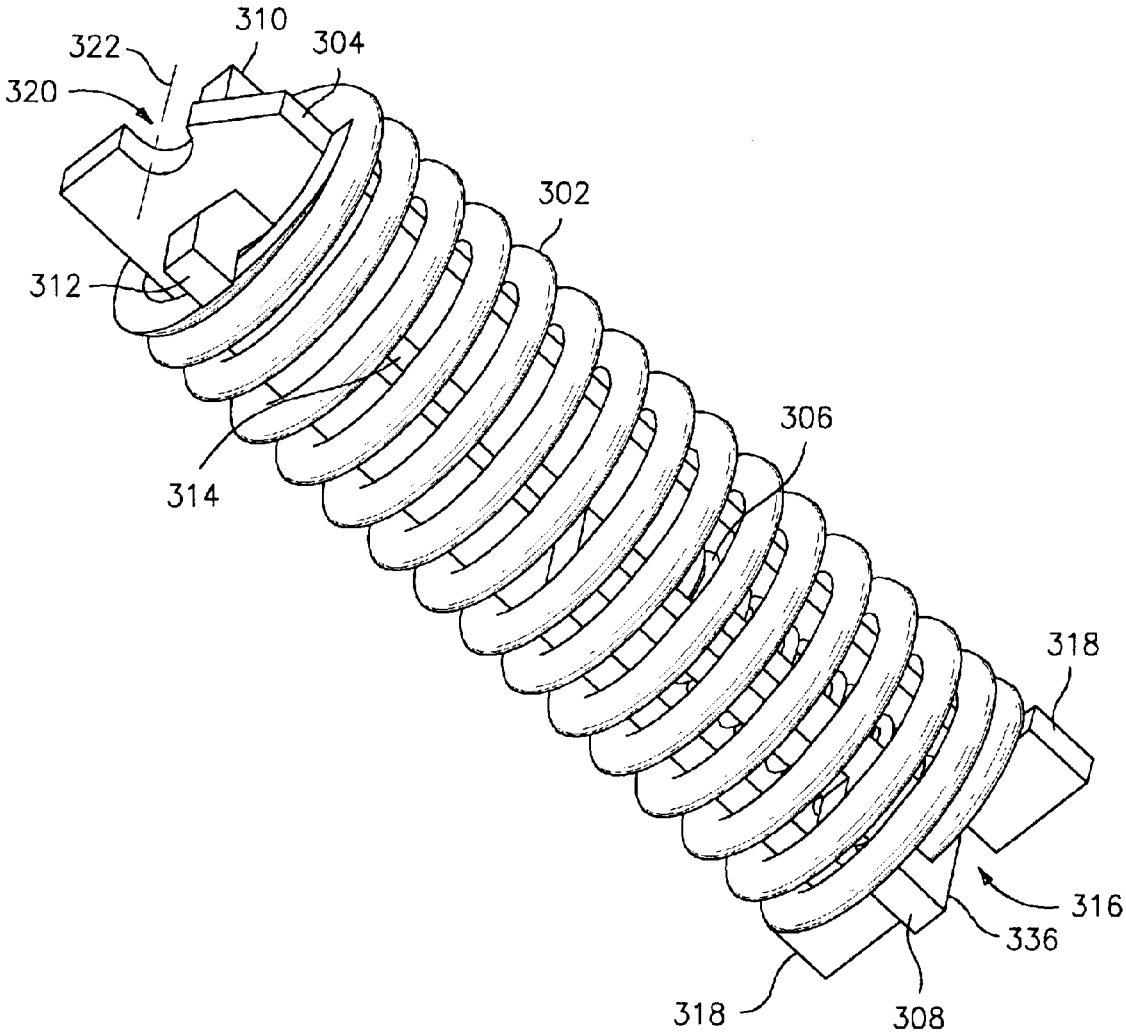
FIG. 4 is a view of the assembled energy storage mechanism of FIG. 1.

Energy storage mechanism 300 further comprises a main spring 302 having a spring constant $k_m$. Main spring guide 304, along with auxiliary spring guide 308 and auxiliary spring 306 engaged thereto, is positioned within the interior part of main spring 302 such that one end of main spring 302 abuts flanges 318. A locking pin 310 (FIG. 7) is passed through first closed slot 312 such that the opposing end of main spring 302 abuts locking pin 310 so as to capture and lock main spring 302 between locking pin 310 and flanges 318. As seen in FIG. 4 the assembled arrangement of main spring 302, main spring guide 304, auxiliary spring 306, auxiliary spring guide 308 and locking pin 310 form a cooperative mechanical unit. In the interest of clarity in the description of energy storage mechanism 300 in FIGS. 1 and 4, reference is made to FIGS. 2 and 3 showing auxiliary spring guide 308 and main spring guide 304 respectively.

Figure 5:
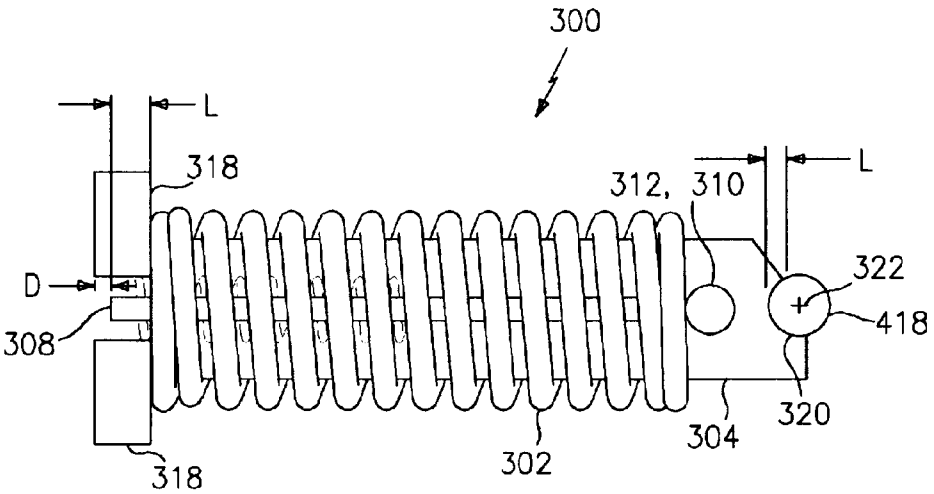
FIG. 5 is a view of the assembled energy storage mechanism of FIG. 1 showing the movement of the auxiliary spring guide relative to the main spring guide and the assembled energy storage mechanism engaged to a side plate pin.
Figure 6:
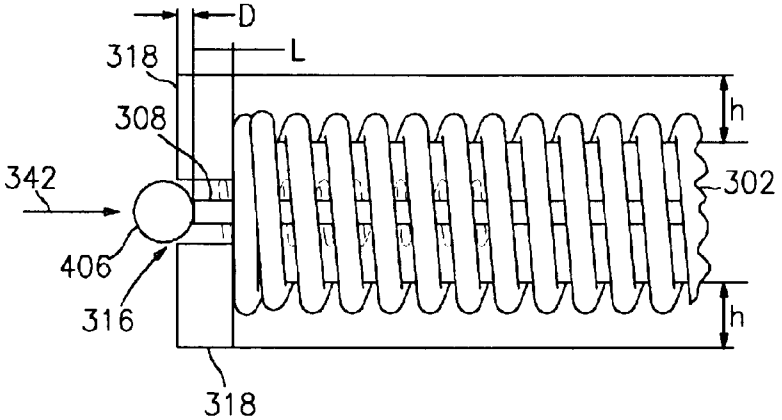
FIG. 6 is a more detailed view of a segment of the assembled energy storage mechanism of FIG. 5 showing the assembled energy storage mechanism engaged to a drive plate pin.

Reference is now made to FIGS. 5 and 6. FIG. 5 depicts the assembled energy storage mechanism 300. A side plate pin 418, affixed to a side plate (not shown), is retained within receptacle 320 so as to allow energy storage mechanism 300 to rotate about a spring assembly axis 322. In FIG. 6, a drive plate pin 406, affixed to a drive plate (not shown), is retained against auxiliary spring guide 308 and between fork-like members 338 in the end of main spring guide 304 containing open slot 316. Drive plate pin 406 is so retained in open slot 316 at an initial displacement "D" with respect to the ends of flanges 318. Thus, as seen in FIGS. 5 and 6, the assembled energy storage mechanism 300 is captured between side plate pin 418 (FIG. 5), drive plate pin 406 (FIG. 6), receptacle 320 and open slot 316. Energy storage mechanism 300 is held firmly therebetween due to the force of auxiliary spring 306 acting against auxiliary spring guide 308, against drive plate pin 406, against main spring guide 304 and against side plate pin 418.

As seen in FIG. 5, auxiliary spring guide 308 is operative to move independent of main spring 302 over a distance "L" relative to main spring guide 304 by the application of a force acting along a line 342 as seen in FIG. 6. When auxiliary spring guide 308 has traversed the distance "L," side plate pin 418 comes clear of receptacle 320 and energy storage mechanism 300 may be disengaged from side plate pin 418 and drive plate pin 406.

As best understood from FIGS. 5 and 6, the spring constant, $k_a$, for auxiliary spring 306 is sufficient to firmly retain assembled energy storage mechanism 300 between side plate pin 418 and drive plate pin 406, but also such that only a minimal amount of effort is required to compress auxiliary spring 306 and allow auxiliary spring guide 308 to move the distance "L." This allows energy storage mechanism 300 to be easily removed by hand from between side plate pin 418 and drive plate pin 406.

Figure 7:
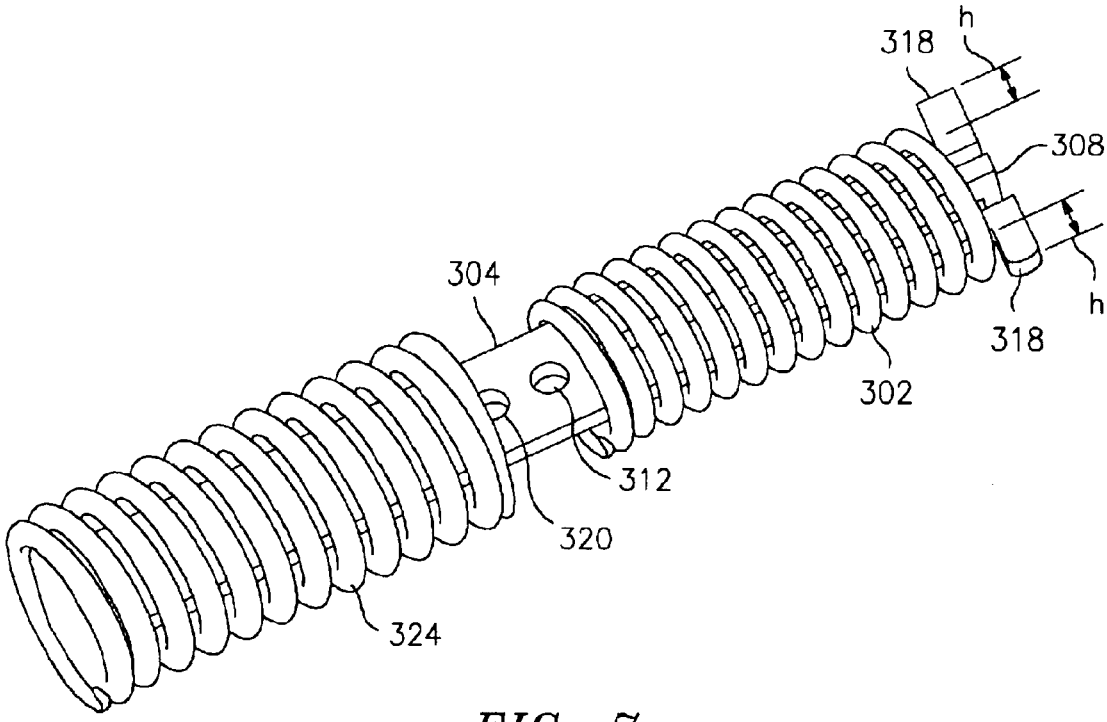
FIG. 7 is a three dimensional view of the energy storage mechanism of FIG. 1 including a second spring, coaxial with the main spring of FIG. 1.

Referring to FIG. 7, a coaxial spring 324, having a spring constant $k_c$ and aligned coaxial with main spring 302, is shown. Coaxial spring 324 may be engaged to main spring guide 304 between flanges 318 and locking pin 310 (not shown) in the same manner depicted in FIG. 4 for main spring 302, thus providing energy storage mechanism 300 with a total spring constant of $k_T=k_m+k_c$. Flanges 318 extend a distance "h" sufficient to accommodate main spring 302 and coaxial spring 324.

Thus, energy storage mechanism 300 is a modular unit that can be easily removed and replaced in the field or in the factory with a new or additional main spring 302. This allows for varying the amount of energy that can be stored in energy storage mechanism 300 without the need for special or additional tools.

Figure 20:
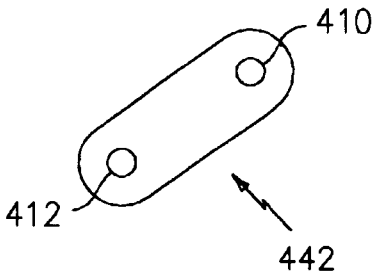
FIG. 20 is a view of the first latch link of the circuit breaker motor operator of FIG. 9.
Figure 21:
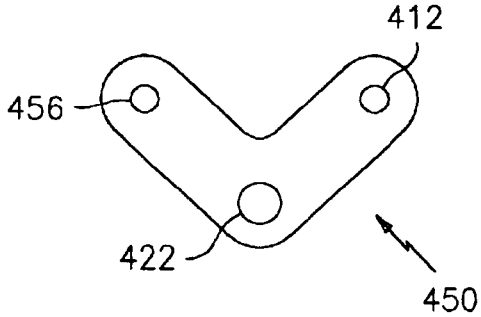
FIG. 21 is a view of the second latch link of the circuit breaker motor operator of FIG. 9.

Referring to FIGS. 9–16, a molded case circuit breaker (MCCB) is shown generally at 100. Molded case circuit breaker 100 includes a circuit breaker handle 102 extending therefrom is coupled to a set of circuit breaker contacts (not shown). The components of the circuit breaker motor operator of the present invention are shown in FIGS. 9–16 generally at 200. Motor operator 200 generally comprises a holder, such as carriage 202 coupled to circuit breaker handle 102, energy storage mechanism 300, as described above, and a mechanical linkage system 400. Mechanical linkage system 400 is connected to energy storage mechanism 300, carriage 202 and a motor drive assembly 500 (FIGS. 20 and 21). Carriage 202, energy storage mechanism 300 and mechanical linkage system 400 act as a cooperative mechanical unit responsive to the action of motor drive assembly 500 and circuit breaker handle 102 to assume a plurality of configurations. In particular, the action of motor operator 200 is operative to disengage or reengage the set of circuit breaker contacts coupled to circuit breaker handle 102. Disengagement (i.e., opening) of the set of circuit breaker contacts interrupts the flow of electrical current through molded case circuit breaker 100, as is well known. Reengagement (i.e., closing) of circuit breaker contacts allows electrical current to flow through molded case circuit breaker 100.

Figure 9:
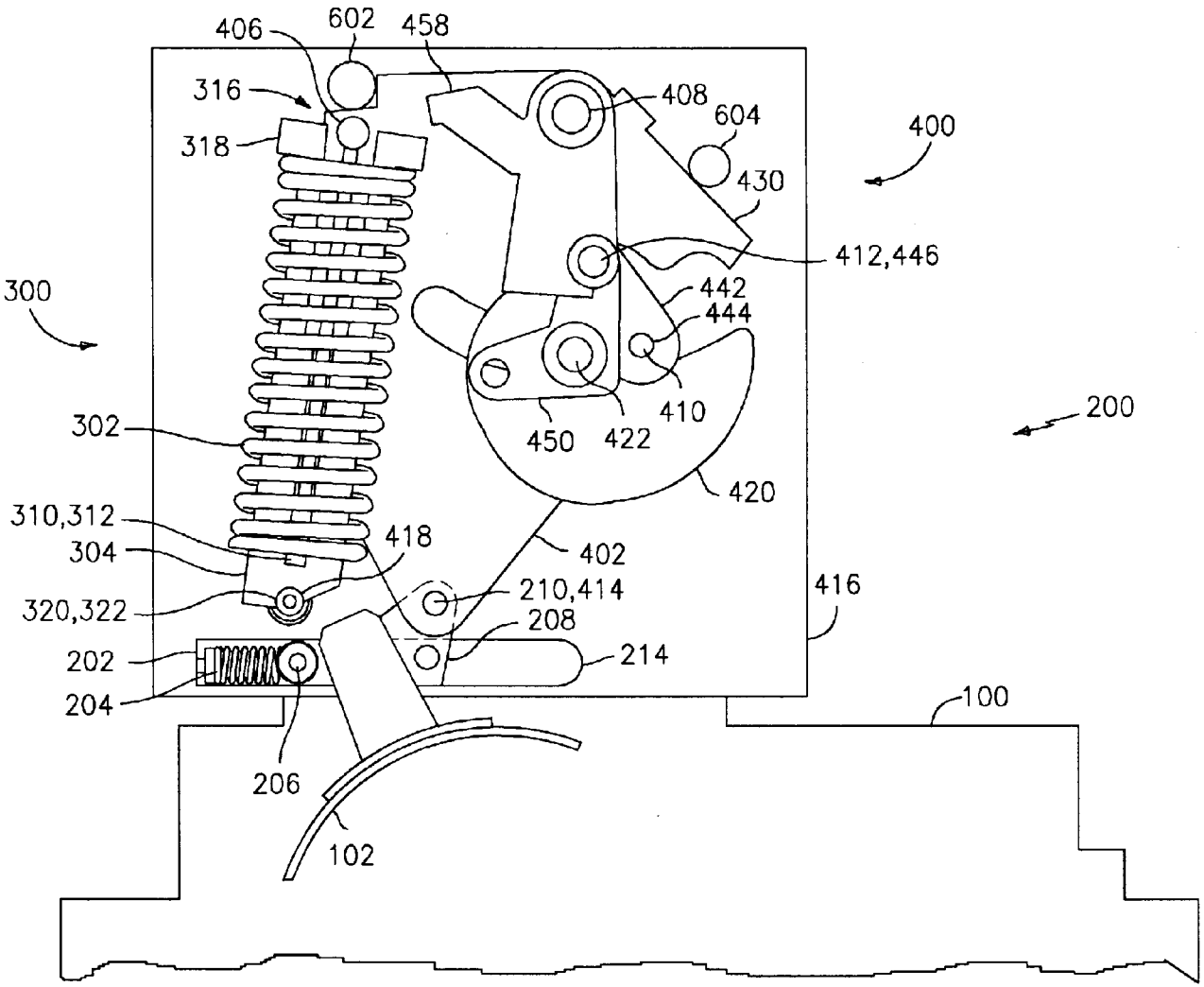
FIG. 9 is a side view of the circuit breaker motor operator of the present invention in the CLOSED position.
Figure 14:
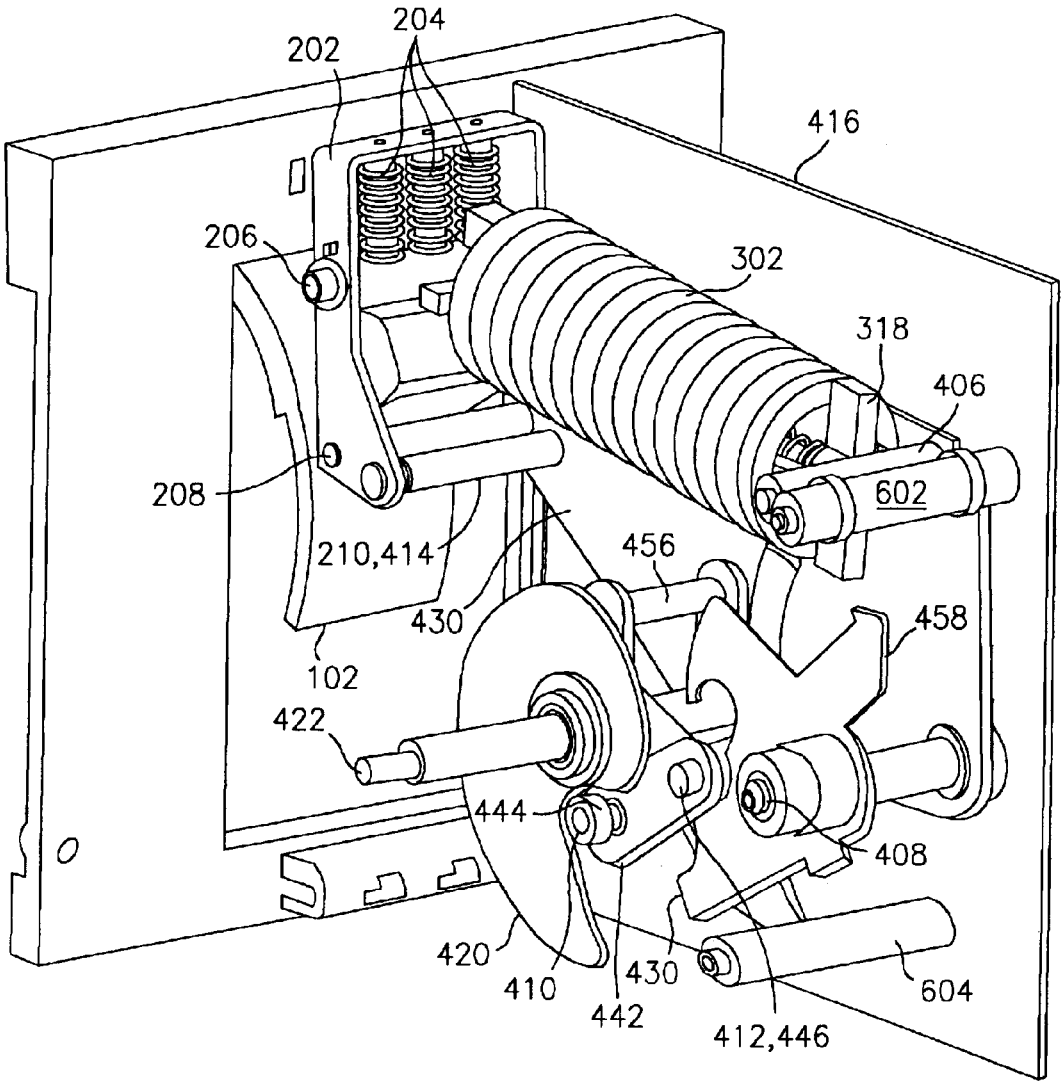
FIG. 14 is a first three dimensional view of the circuit breaker motor operator of FIG. 9.
Figure 15:
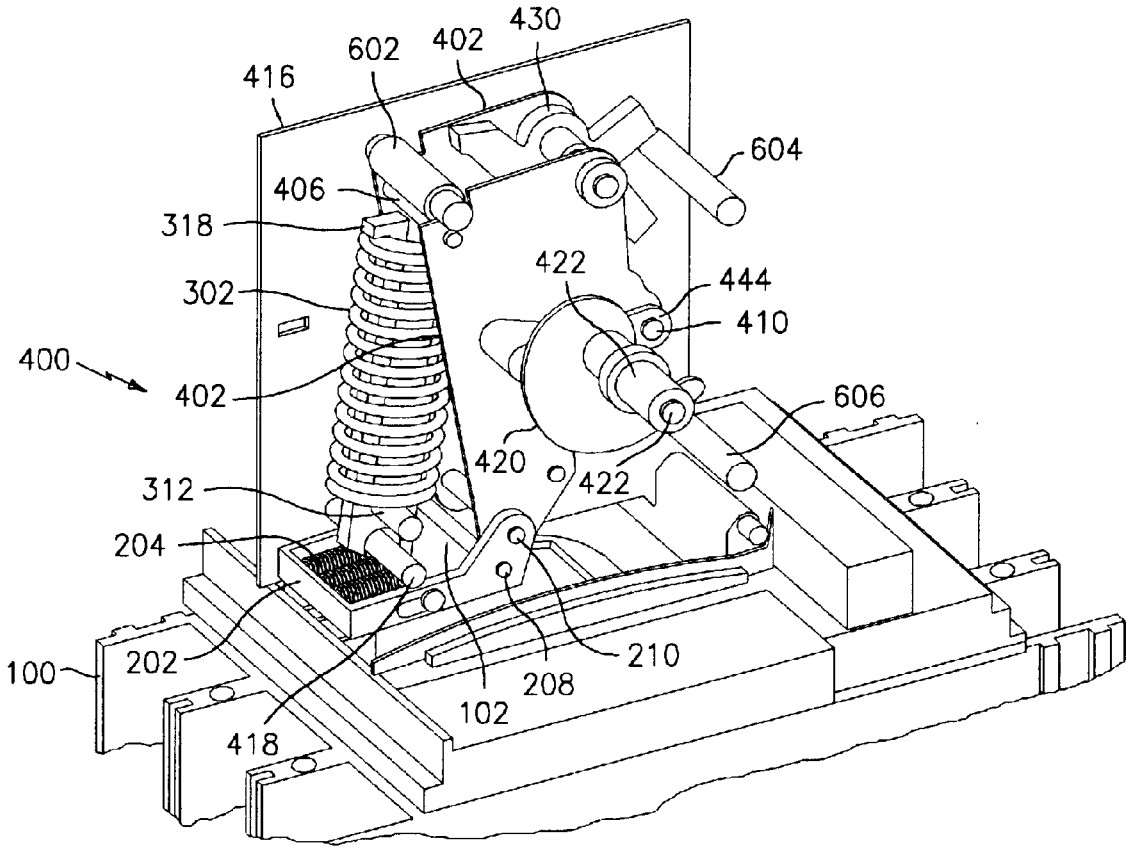
FIG. 15 is a second three dimensional view of the circuit breaker motor operator of FIG. 9.
Figure 16:
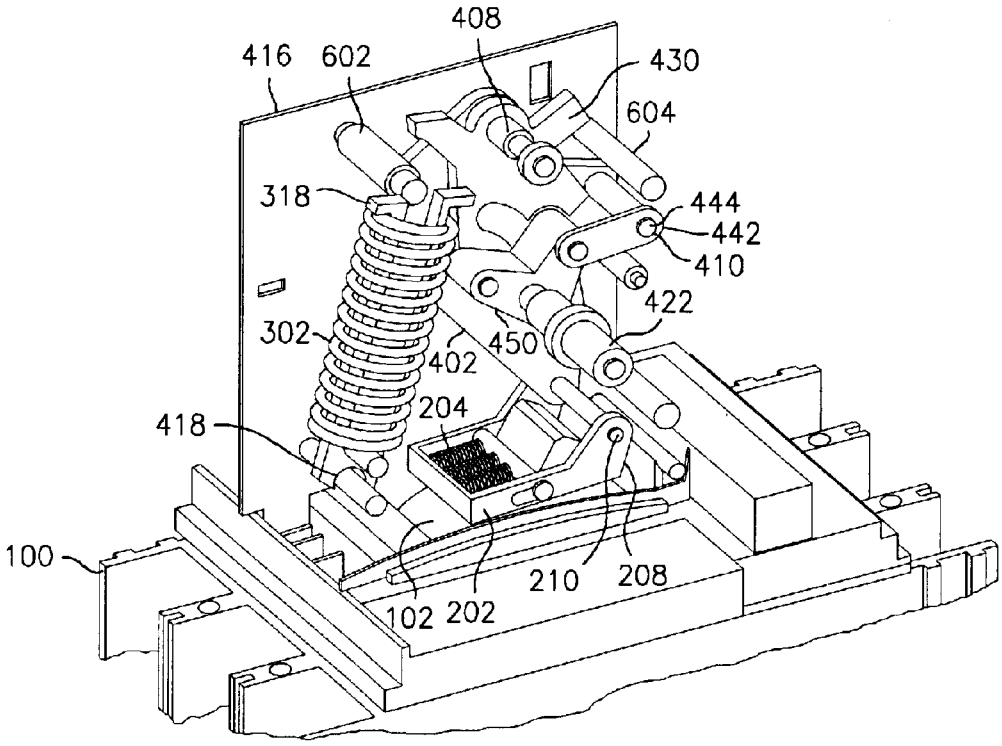
FIG. 16 is a third three dimensional view of the circuit breaker motor operator of FIG. 9.

More particularly in FIG. 9, in conjunction with FIGS. 14, 15 and 16, mechanical linkage system 400 comprises a pair of side plates 416 held substantially parallel to one another by a set of braces 602, 604 and connected to case circuit breaker 100. A pair of drive plates 402 (FIG. 19) are positioned interior, and substantially parallel to the pair of side plates 416. Drive plates 402 are connected to one another by way of, and are rotatable about, a drive plate axis 408. Drive plate axis 408 is connected to the pair of side plates 416. The pair of drive plates 402 include a drive plate pin 406 connected therebetween and engaged to energy storage mechanism 300 at open slot 316 of main spring guide 304.

Figure 24:
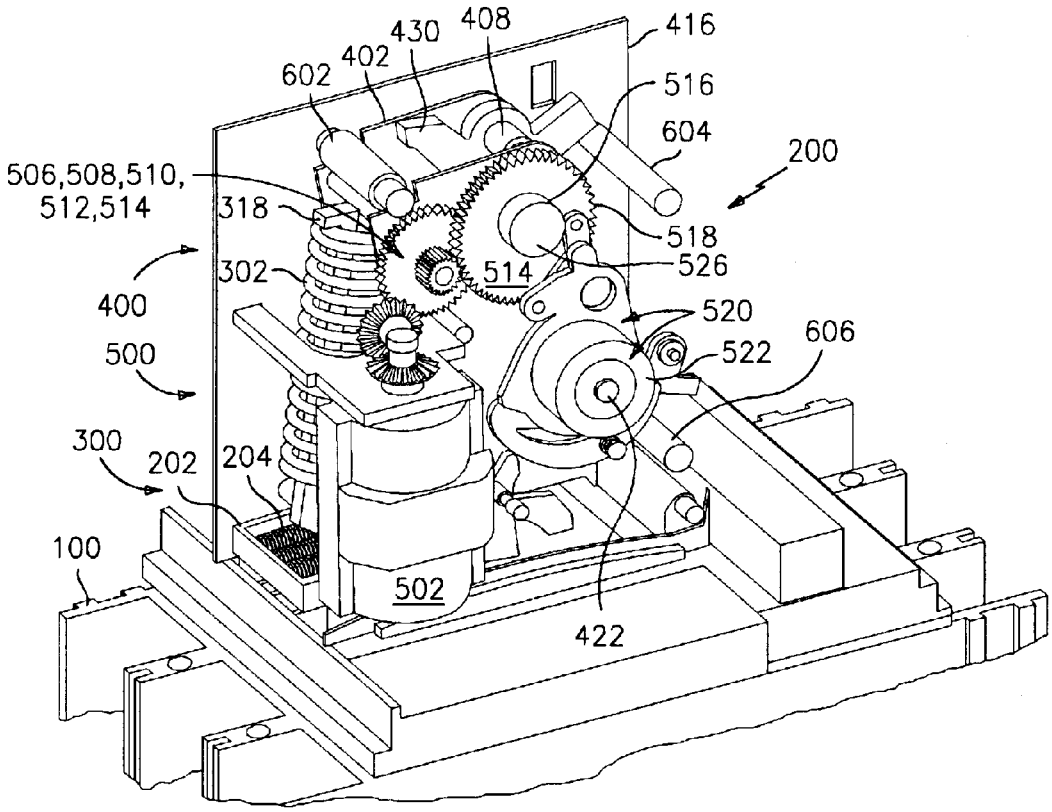
FIG. 24 is a three dimensional view of the circuit breaker motor operator of FIG. 9, excluding a side plate.
Figure 17:
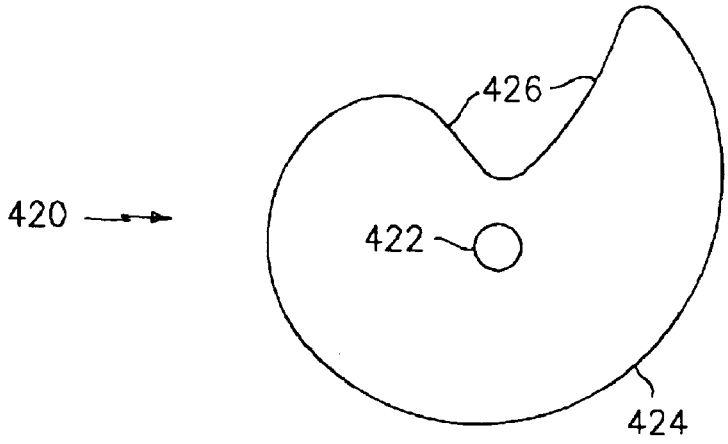
FIG. 17 is a view of the cam of the circuit breaker motor operator of FIG. 9.
Figure 18:
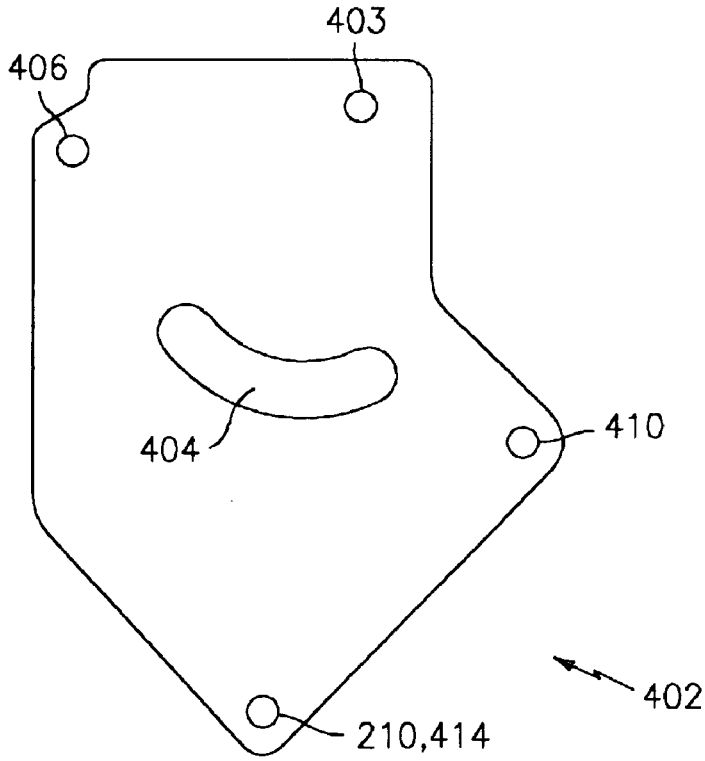
FIG. 18 is a view of the drive plate of the circuit breaker motor operator of FIG. 9.

A connecting rod 414 connects the pair of drive plates 402 and is rotatably connected to carriage 202 at axis 210. A cam 420 (as seen in FIG. 17), rotatable on a cam shaft 422, includes a first cam surface 424 and a second cam surface 426 (FIG. 18). Cam 420 is, in general, of a nautilus shape wherein second cam surface 426 is a concavely arced surface and first cam surface 424 is a convexly arced surface. Cam shaft 422 passes through a slot 404 in each of the pair of drive plates 402 and is supported by the pair of side plates 416. Cam shaft 422 is further connected to motor drive assembly 500 (FIGS. 24 and 25) from which the cam 420 is driven in rotation.

Figure 8:
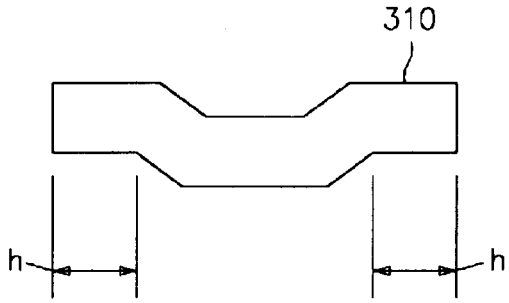
FIG. 8 is a view of the locking member of the energy storage mechanism of FIG. 1.
Figure 19:
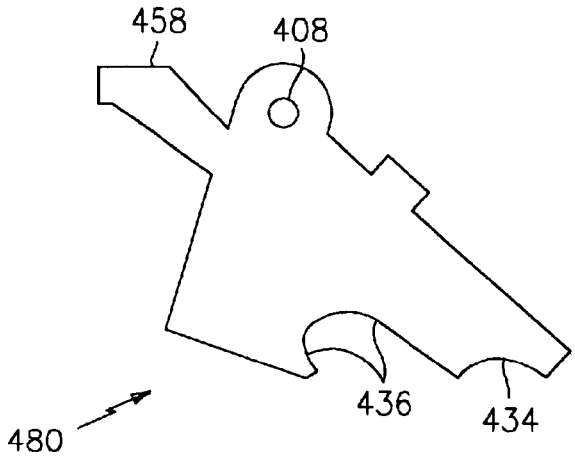
FIG. 19 is a view of the latch plate of the circuit breaker motor operator of FIG. 9.
Figure 22:
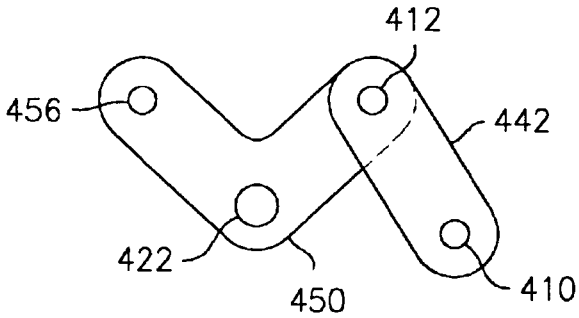
FIG. 22 is a view of the connection of the first and second latch links of the circuit breaker motor operator of FIG. 9.

A pair of first latch links 442 (FIG. 21) are coupled to a pair of second latch links 450 (FIG. 22), about a link axis 412 (FIG. 19). Second latch link 450 is also rotatable about cam shaft 422. First latch links 442 and second latch links 450 are interior to and parallel with drive plates 402. A roller 444 is coupled to a roller axis 410 connecting first latch links 442 to drive plate 402. Roller 444 is rotatable about roller axis 410. Roller axis 410 is connected to drive plates 402 and roller 444 abuts, and is in intimate contact with, second cam surface 426 of cam 420. A brace 456 connects the pair of second latch links 450. An energy release mechanism, such as a latch plate 430 (FIG. 16), is rotatable about drive plate axis 408 and is in intimate contact with a rolling pin 446 rotatable about link axis 412. Rolling pin 446 moves along a first concave surface 434 and a second concave surface 436 (as seen in FIG. 20) of latch plate 430. First concave surface 434 and second concave surface 436 of latch plate 430 are arc-like, recessed segments along the perimeter of latch plate 430 operative to receive rolling pin 446 and allow rolling pin 446 to be seated therein as latch plate 430 rotates about drive plate axis 408. Latch plate 430 includes a releasing lever 458 to which a force may be applied to rotate latch plate 430 about drive plate axis 408. In FIG. 8, latch plate 430 is also in contact with brace 604.

Carriage 202 is connected to drive plate 402 by way of connecting rod 414 of axis 210 and is rotatable thereabout. Carriage 202 comprises a set of retaining springs 204, a first retaining bar 206 and a second retaining bar 208. Retaining springs 204, disposed within carriage 202 and acting against first retaining bar 206, retain circuit breaker handle 102 firmly between first retaining bar 206 and second retaining bar 208. Carriage 202 is allowed to move laterally with respect to side plates 416 by way of first retaining bar 206 coupled to a slot 214 in each of side plates 416. Carriage 202 moves back and forth along slots 214 to toggle circuit breaker handle 102 back and forth between the position of FIG. 8 and that of FIG. 12.

Referring to FIG. 9, molded case circuit breaker 100 is in the closed position (i.e., electrical contacts closed) and no energy is stored in main spring 302. Motor operator 200 operates to move circuit breaker handle 102 between the closed position of FIG. 9 and the open position (i.e., electrical contacts open) of FIG. 12. In addition, when molded case circuit breaker 100 trips due to, for example an overcurrent condition in an associated electrical system, motor operator 200 operates to reset an operating mechanism (not shown) within circuit breaker 100 by moving the handle to the open position of FIG. 13.

Figure 10:
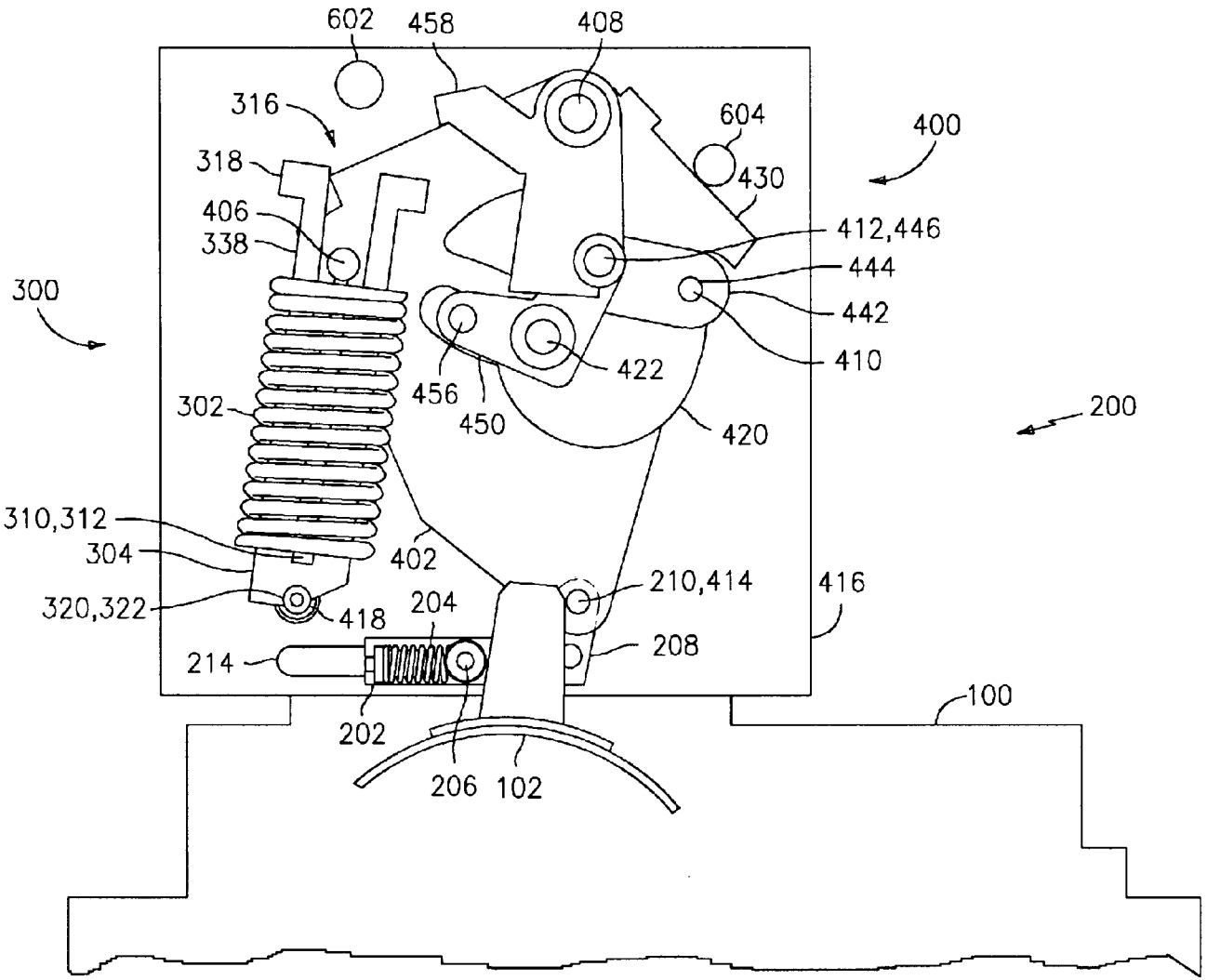
FIG. 10 is a side view of the circuit breaker motor operator of FIG. 9 passing from the closed position of FIG. 9 to the OPEN position.
Figure 11:
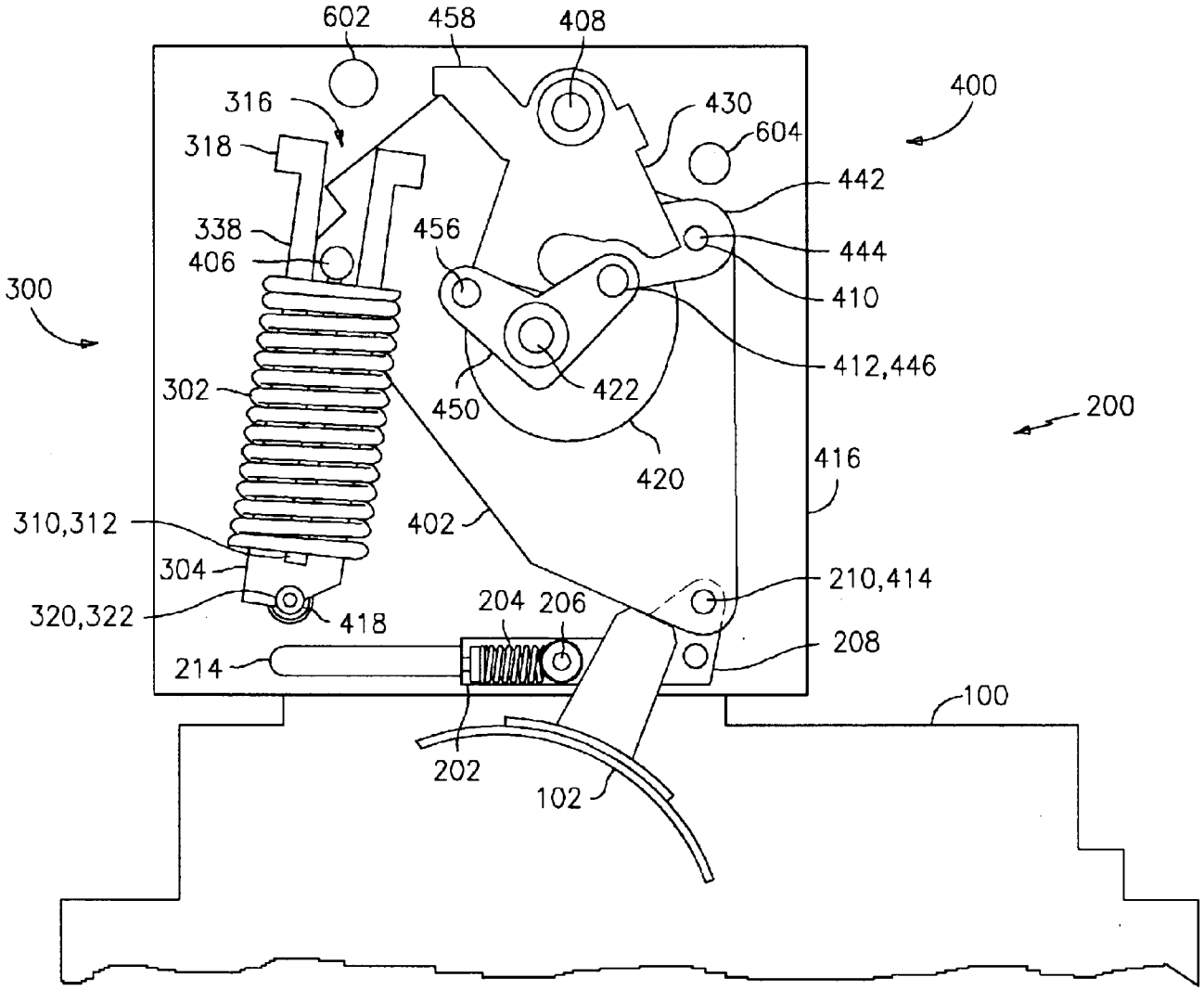
FIG. 11 is a side view of the circuit breaker motor operator of FIG. 9 passing from the closed position of FIG. 9 to the OPEN position.
Figure 12:
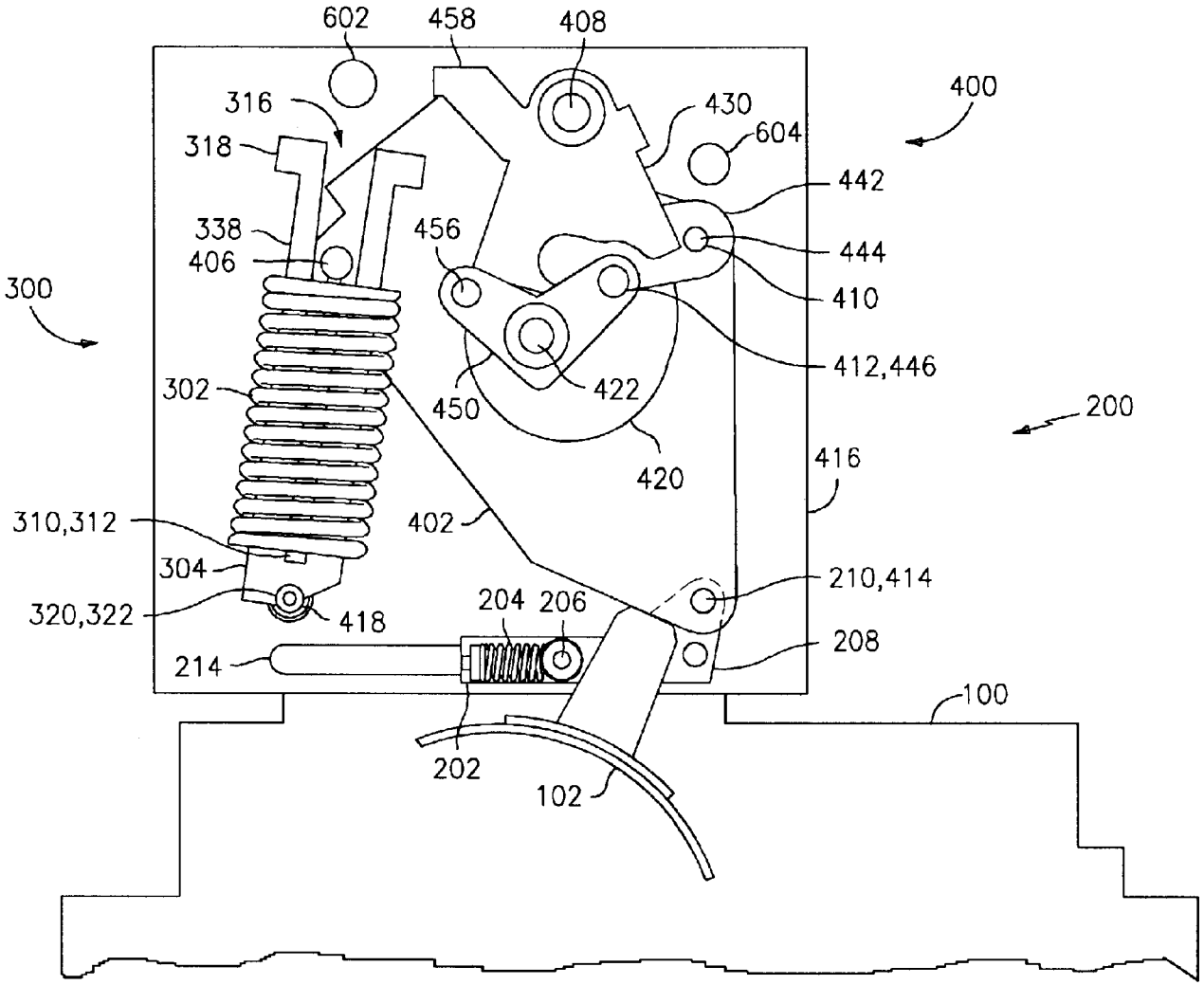
FIG. 12 is a side view of the circuit breaker motor operator of FIG. 9 passing from the closed position of FIG. 9 to the OPEN position.
Figure 13:
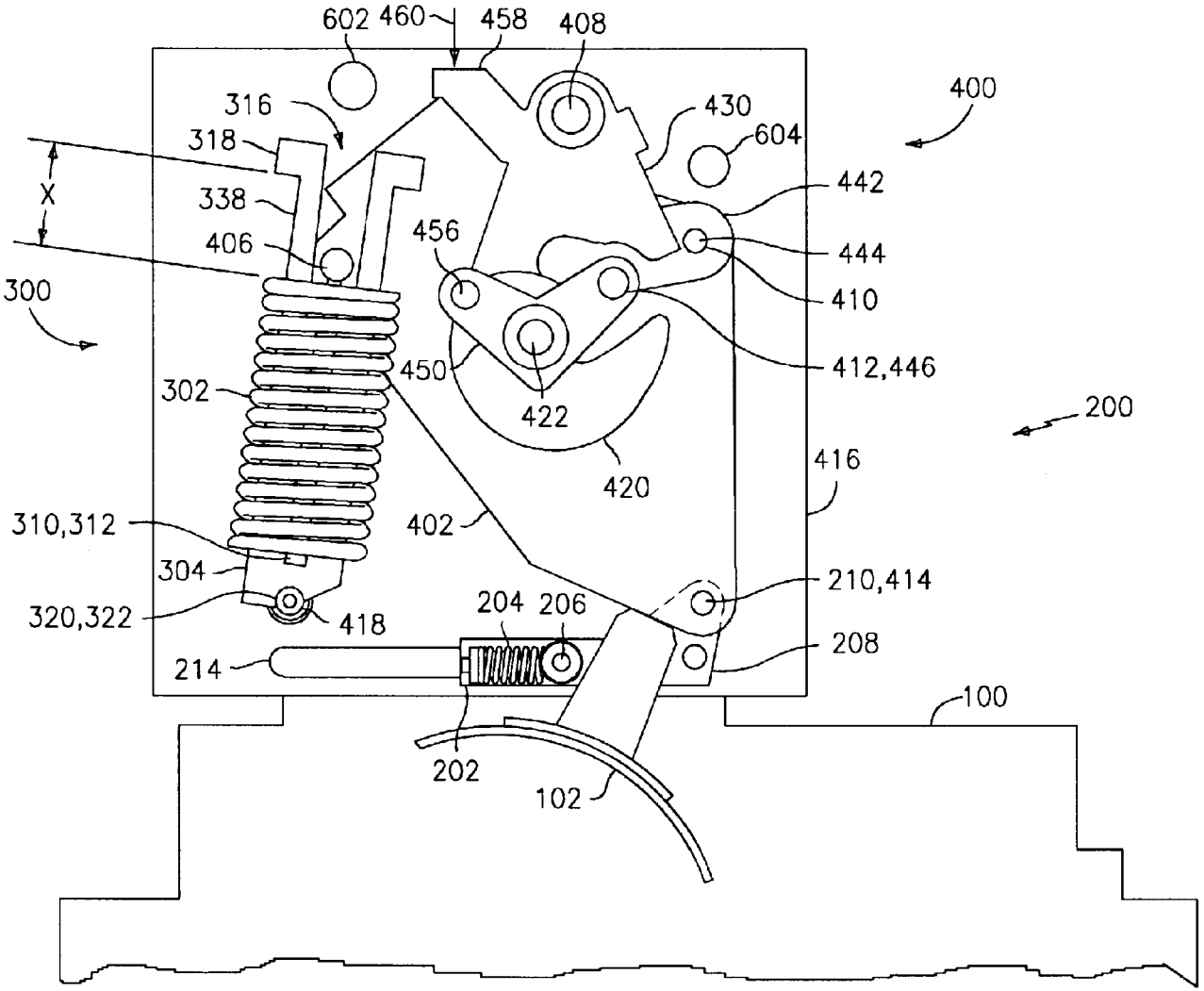
FIG. 13 is a side view of the circuit breaker motor operator of FIG. 9 in the OPEN position.

To move the handle from the closed position of FIG. 9 to the open position of FIG. 13, motor drive assembly 500 rotates cam 420 clockwise as viewed on cam shaft 422 such that mechanical linkage system 400 is sequentially and continuously driven through the configurations of FIGS. 10, 11 and 12 Referring to FIG. 10 cam 420 rotates clockwise about cam shaft 422. Drive plates 402 are allowed to move due to slot 404 in drive plates 402. Roller 444 on roller axis 410 moves along first cam surface 424 of cam 420. The counterclockwise rotation of drive plates 402 drives the drive plate pin 406 along open slot 316 thereby compressing main spring 302 and storing the energy therein. Energy storage mechanism 300 rotates clockwise about spring assembly axis 322 and side plate pin 418. Latch plate 430, abutting brace 604, remains fixed with respect to side plates 416.

Referring to FIG. 11, drive plate 402 rotates further counterclockwise causing drive plate pin 406 to further compress main spring 302. Cam 420 continues to rotate clockwise. Rolling pin 446 moves from second concave surface 436 (FIG. 20) of latch plate 430 partially to first concave surface 434 (FIG. 20), and latch plate 430 rotates clockwise away from brace 604. Drive plate pin 406 compresses main spring 302 further along open slot 316.

Referring to FIGS. 12 and 13, latch plate 430 rotates clockwise until rolling pin 446 rests fully within first concave surface 434 (FIG. 20). Roller 444 remains in intimate contact with first cam surface 424 (FIG. 18) as cam 420 continues to turn in clockwise direction. Cam 420 has completed its clockwise rotation and roller 444 is disengaged from cam 420. Rolling pin 446 remains in contact with first concave surface 434 (FIG. 20) of latch plate 430.

Figure 26:
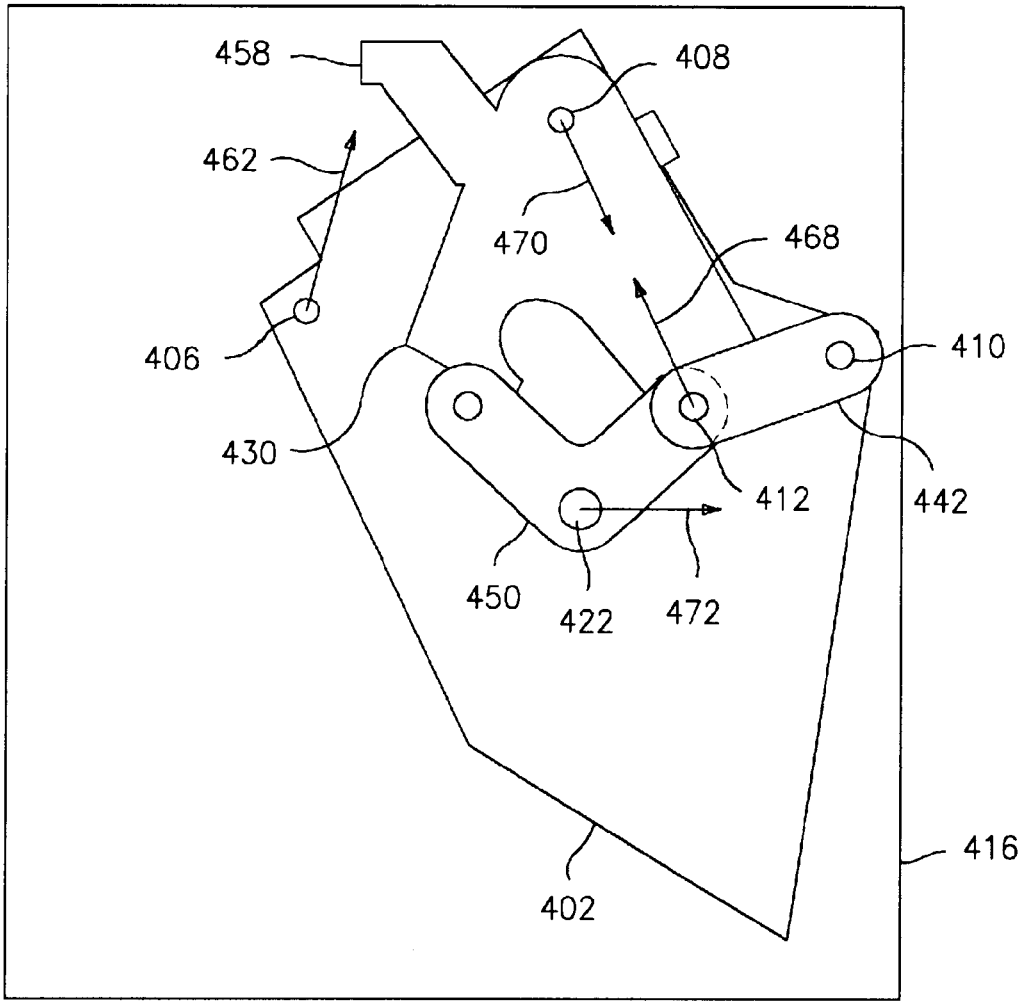
FIG. 26 is a force and moment diagram of the circuit breaker motor operator of FIG. 9.

Mechanical linkage system 400 thence comes to rest in the configuration of FIG. 13. In proceeding from the configuration of FIG. 9 to that of FIG. 13, main spring 302 is compressed a distance "x" by drive plate pin 406 due to counterclockwise rotation of drive plates 402 about drive plate axis 408. The compression of main spring 302 thus stores energy in main spring 302 according to the equation $E=\frac{1}{2}k_m x^2$, where x is the displacement of the main spring 302. Motor operator 200, energy storage mechanism 300 and mechanical linkage system 400 are held in the stable position of FIG. 13 by first latch link 442, second latch link 450 and latch plate 430. The positioning of first latch link 442 and second latch link 450 with respect to one another and with respect to latch plate 430 and cam 420 is such as to prevent the expansion of the compressed main spring 302, and thus to prevent the release of the energy stored therein. As seen in FIG. 26, this is accomplished due to the fact that although there is a force acting along the line 462 (as seen in FIG. 26) caused by the compressed main spring 302, which tends to rotate the drive plates 402 and first latch link 442 clockwise about drive plate axis 408, cam shaft 422 is fixed with respect to side plates 416 which are in turn affixed to molded case circuit breaker 100. Thus, in the configuration FIG. 13, first latch link 442 and second latch line 450 form a rigid linkage.

Figure 23:
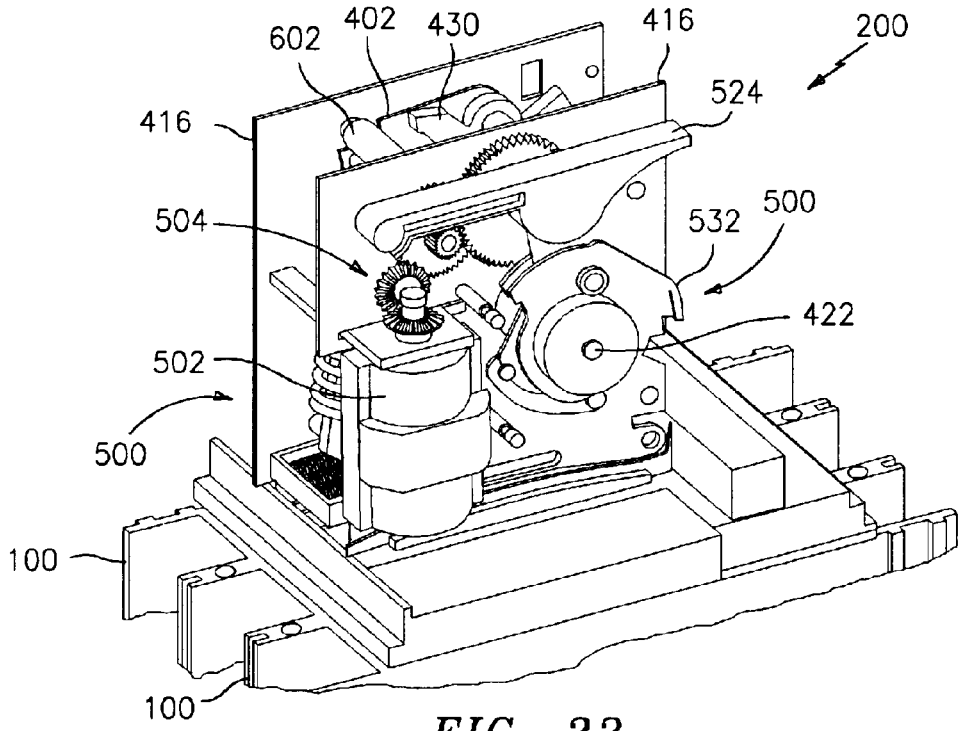
FIG. 23 is a three dimensional view of the circuit breaker motor operator of FIG. 9 including the motor drive assembly.

There is a tendency for the linkage of first latch link 442 and second latch link 450 to rotate about link axis 412 and collapse. However, this is prevented by a force acting along line 470 (FIG. 26) countering the force acting along line 468 (FIG. 23). The reaction force acting along line 472 (as seen in FIG. 26) at the cam shaft counters the moment caused by the spring force acting along line 462 (FIG. 26). Thus forces and moments acting upon motor operator 200 in the configuration of FIG. 13 are balanced and no rotation of mechanical linkage system 400 may be had.

Referring to FIG. 13, molded case circuit breaker 100 is illustrated in the open position. To proceed from the configuration of FIG. 13 and return to the configuration of FIG. 9 (i.e., electrical contacts closed), a force is applied to latch plate 430 on the latch plate lever 458 at 460. The application of this force acts so as to rotate latch plate 430 counterclockwise about drive plate axis 408 and allow rolling pin 446 to move from first concave surface 434 to second concave surface 436 as in FIGS. 9 and 20 respectively. This action releases the energy stored in main spring 302 and the force acting on the drive plate pin 406 causes the drive plate 402 to rotate clockwise about drive plate axis 408. The clockwise rotation of drive plate 402 applies a force to circuit breaker handle 102 at second retaining bar 208 throwing circuit breaker handle 102 leftward, with main spring 302, latch plate 430 and mechanical linkage system 400 coming to rest in the position of FIG. 9.

Referring to FIG. 23, motor drive assembly 500 is shown engaged to motor operator 200, energy storage mechanism 300 and mechanical linkage system 400. Motor drive assembly 500 comprises a motor 502 (FIG. 24) geared to a gear train 504 (FIG. 20). Gear train 504 (FIG. 24) comprises a plurality of gears 506, 508, 510, 512, 514. One of the gears 514 of gear train 504 is rotatable about an axis 526 and is connected to a disc 516 at axis 526. Disc 516 is rotatable about axis 526. However, axis 526 is displaced from the center of disc 516. Thus, when disc 516 rotates due to the action of motor 502 and gear train 504, disc 516 acts in a cam-like manner providing eccentric rotation of disc 516 about axis 526.

Figure 25:
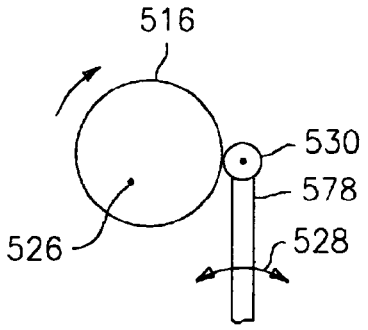
FIG. 25 is a view of the ratcheting mechanism of the motor drive assembly of the circuit breaker motor operator of FIG. 9.

Motor drive assembly 500 further comprises a unidirectional clutch bearing 522 coupled to cam shaft 422 and a charging plate 520 connected to a ratchet lever 518. A roller 530 is coupled to one end of ratchet lever 518 and rests against disc 516 (FIG. 25). Thus, as disc 516 rotates about axis 526, ratchet lever 518 toggles back and forth as seen at 528 in FIG. 25. This back and forth action ratchets unidirectional clutch bearing 522 a prescribed angular displacement, Θ, about cam shaft 422 which in turn ratchets cam 420 (FIG. 17) by a like angular displacement.

Referring to FIG. 23, motor drive assembly 500 further comprises a manual handle 524 (FIG. 24) coupled to unidirectional clutch bearing 422 whereby unidirectional clutch bearing 422, and thus cam 420 (FIG. 17), may be manually ratcheted by repeatedly depressing manual handle 524 (FIG. 23).

The method and system of an exemplary embodiment stores energy in one or more springs 302 which are driven to compression by at least one drive plate 402 during rotation of at least one recharging cam 420 mounted on a common shaft 422. The drive plate is hinged between two side plates 416 of the energy storage mechanism and there is at least one roller follower 444 mounted on the drive plate which cooperates with the recharging cam during the charging cycle. The circuit breaker handle is actuated by the stored energy system by a linear rack 202 coupled to the drive plate. The drive plate is also connected to at least one compression spring 302 in which the energy is stored. The stored energy mechanism is mounted in front of the breaker cover 100 and is secured to the cover by screws.

The recharging cam 420 is driven in rotation about its axis by a motor 502 connected to one end of the shaft by a reducing gear train 504 and a unidirectional clutch bearing assembly 522 in the auto mode and by a manual handle 524 connected to the same charging plate 520 in the manual mode.

At the end of the charging cycle the recharging cam 420 disengages completely from the drive plate 420 and the drive plate 402 is latched in the charged state by a latch plate 430 and the latch links. The stored energy is releases by the actuation of a closing solenoid trip coil in the auto mode, activated by a solenoid, and by an ON pushbutton in the manual mode on the latch plate which pushes it in rotation about its axis setting free the drive plate to rotate about the hinge to its initial position. The advantage of such a system is that because of the complete disengagement of the recharging cam and the drive plate, there is no resistance offered by the charging system when the drive plate is released by the delatching of the latch plate. This ensures minimum wasteage of stored energy while closing the breaker, less wear on the recharging cam and roller follower. There is also much lower closing time of the breaker. Thus, the drive plate holding the stored energy required to close the breaker is disengaged from the recharging cam and shaft used for charging, thus allowing for the quick closing of the breaker using a minimum signal power and with high reliability. The system minimizes the stored energy required for closing the breaker mechanism and reduces the closing time, thereby optimizing the mechanism size and cost.

At the end of charging cycle, the control cam mounted on the common shaft pushes the drive lever in rotation about its axis and the drive lever, in turn, pushes the charging plate away from the eccentric charging gear, thereby disconnecting the motor from the kinematic link and allowing free rotation of the motor. During discharge of the main spring the control cam allows the drive lever to come back to its normal position by a bias spring and hence the charging plate is connected again to the eccentric charging gear to complete the kinematic link for a fresh charging cycle.

In motor operator, motor power it is disengaged from the charging mechanism by direct cam action, thereby eliminating excessive stress on the charging mechanism and avoiding overloading the motor. The cam assembly achieves this using a few mechanical components and therefore, decreases the cost of the motor operator and enhances its longevity.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mechanized system for manipulating an operating handle of a circuit interruption mechanism, comprising:

a mechanical linkage system coupled to an energy storage mechanism, said energy storage mechanism assuming a plurality of states, each state having a prescribed amount of energy stored in said energy storage mechanism, said energy storage mechanism providing an urging force to said mechanical linkage system, said mechanical linkage system being coupled to a carriage assembly;

a motor drive assembly connected to said mechanical linkage system for driving said energy storage mechanism from a first state of said plurality of states to a second state of said plurality of states;

a release mechanism for disengaging said motor drive assembly from said mechanical linkage system when said energy storage mechanism is driven from said first state of said plurality of states to said second state; and an energy release mechanism coupled to said mechanical linkage system for releasing said energy stored in said energy storage mechanism.

2. The system as in claim 1, wherein said motor drive assembly further comprises:

a motor;

a gear train geared to said motor; and a ratcheting system coupled to said gear train and connected to a cam on a cam shaft for rotatively ratcheting said cam on said cam shaft in response to an action of said motor.

3. The system as in claim 2, wherein said ratcheting system further comprises:

a centrically rotatable disk coupled to said gear train;

an unidirectional clutch bearing rotatively coupled to said cam shaft;

a lever coupled to said disk and coupled to said unidirectional clutch bearing the rotation of said gear train being responsive to said motor and said gear train rotates said cam shaft with a prescribed angular displacement in response to movement of said gear train.

4. The system as in claim 2, further comprising:

a) a manual ratcheting lever connected to said unidirectional clutch bearing for manually ratcheting said cam shaft to said prescribed angular displacement.

5. The system as in claim 1, wherein said energy storage mechanism is a spring capable of being compressed.

6. A method for manipulating an operating handle of a circuit breaker, comprising;

driving a recharging cam, said recharging cam being coupled to a rotatably mounted drive plate, said drive plate compressing a spring as said drive plate is rotated by said recharging cam;

disengaging said recharging cam from said drive plate when said spring is compressed to a predetermined value;

latching said drive plate in a position corresponding to said compressed spring; and activating a release mechanism, said release mechanism releasing the predetermined value of said compressed spring for manipulating said operating handle.

7. The method as in claim 6, wherein said recharging cam is driven by a motor.

8. The method as in claim 7, further comprising:

re-connecting said recharging cam after the compression in said spring has been released.

9. The method as in claim 8, wherein said recharging cam is being driven in rotation about its axis by a reducing gear train coupled to said motor and a unidirectional clutch bearing assembly.

10. The method as in claim 7, further comprising:

disengaging said motor from said recharging cam when said spring is compressed.

11. The method in claim 6, wherein said recharging cam is driven manually by a handle connected to said recharging cam.

12. A motor driven system for manipulating an operating handle of a circuit interruption mechanism, comprising:

a recharging cam being driven by a motor;

a drive plate being rotatably mounted to said system, said recharging cam rotating said drive plate as said recharging cam is being driven by said motor;

an energy storage mechanism being compressed by said drive plate as said drive plate is rotated by said recharging cam; and a linear carriage coupled to said drive plate, said linear carriage manipulating said operating handle of said circuit interruption mechanism when said energy storage mechanism is released from its compressed state.

13. The system as in claim 12, wherein said recharging cam is disengaged from said drive plate when said energy storage mechanism is compressed.

14. The system as in claim 12, wherein said drive plate is latched into a position corresponding to a charged state of said energy storage mechanism, said drive plate being latched by a latch plate and latch links.

15. The system as in claim 12, wherein said motor includes a cam assembly to mechanically disconnect and reconnect the motor to the recharging cam.

16. The system as in claim 15, wherein said cam assembly includes:

a control cam;

a drive lever; and a charging lever.

17. The system as in claim 16, wherein the control cam causes said drive lever to rotate about its axis which in turn moves a charging plate away from a gear being manipulated by said motor when a charging cycle of said system is completed.

18. The system as in claim 17, wherein said charging cycle is the compression of said energy storage mechanism.

19. The system as in claim 17, wherein said drive lever is biased by a spring to move said charging plate into a coupling connection with said gear being manipulated by said motor when said the compression of said energy storage mechanism is released.

20. The system as in claim 12, further comprising:

a switch for interrupting the flow of electrical current to said motor after said motor has been mechanically disconnected from said recharging cam.

21. A motor driven system for manipulating an operating handle of a circuit interruption mechanism, comprising:

a recharging cam being driven by a motor;

a drive plate being rotatably mounted to said system, said recharging cam rotating said drive plate as said recharging cam is being driven by said motor;

a spring being compressed by said drive plate as said drive plate is rotated into a latching position by said recharging cam;

a linear carriage coupled to said drive plate, said linear carriage being movably mounted to said system and manipulating said operating handle of said circuit interruption mechanism;

a means for disengaging said recharging cam when said drive plate is in said latching position; and a means for releasing said drive plate from said latching position.

22. The system as in claim 21, wherein said operating handle of said circuit interruption mechanism is manipulated when said drive plate is released from said latching position.

23. The system as in claim 21, further comprising:

a means for re-engaging said recharging cam after said drive plate is released from said latching position and said spring is uncompressed.

24. The system as in claim 21, wherein said means for releasing said drive plate from said latching position is remotely activated by a solenoid.

25. The system as in claim 21, wherein said means for releasing said drive plate from said latching position is manually activated by a switch.

* * * * *